US005078060A

United States Patent [19]

Martin

[11] Patent Number: 5,078,060

[45] Date of Patent: Jan. 7, 1992

[54] CAN CRUSHER APPARATUS

[76] Inventor: Rodney L. Martin, 108 N. Main St., Stevens, Pa. 17578

[21] Appl. No.: 610,163

[22] Filed: Nov. 5, 1990

[51] Int. Cl.[5] ..... D30B 1/04

[52] U.S. Cl. ..... 100/218; 100/245; 100/265; 100/902

[58] Field of Search ..... 100/214, 218, 240, 245, 100/246, 265, 294, 902; 220/23.83

[56] References Cited

U.S. PATENT DOCUMENTS

| | | | |
|---|---|---|---|
| 87,090 | 2/1869 | Bruson | 100/125 |
| 944,823 | 12/1909 | Rohrer | 100/245 |
| 3,411,722 | 11/1968 | Webber | 100/245 |
| 3,469,530 | 9/1969 | Walker | 100/218 |
| 3,980,015 | 9/1976 | Woodard | 100/902 |
| 4,213,387 | 7/1980 | McCaney | 100/902 |
| 4,237,783 | 12/1980 | Tafelski, Jr. | 100/245 |
| 4,249,400 | 2/1981 | Arendt | 100/218 |
| 4,301,722 | 11/1981 | Balbo | 100/245 |
| 4,856,671 | 8/1989 | Reppel | 220/23.83 |

*Primary Examiner*—Harvey C. Hornsby
*Assistant Examiner*—Terrence R. Till
*Attorney, Agent, or Firm*—Leon Gilden

[57] ABSTRACT

An apparatus is provided inclining an upper housing containing spaced parallel side walls, with the side walls including aligned slots. A crusher bar is arranged to crush a can between a floor of the housing as the bar is directed through the slots. A push bar is pivotally mounted to a rear upper wall of the housing to project a crushed can into a storage container removably mounted to a lower forward wall of the housing.

1 Claim, 4 Drawing Sheets

CAN CRUSHER APPARATUS

BACKGROUND OF THE INVENTION

1. Field of the Invention

The field of invention relates to crushing apparatus, and more particularly pertains to a new and improved can crusher apparatus wherein the same provides for the crushing and storage of cans.

2. Description of the Prior Art

The advent of recycling of aluminum cans and the like has generated a storage problem of such cans. Typically, the cans are of a cylindrical configuration and storage of the empty hollow cans in an uncrushed state is of a cumbersome and space consuming nature tending to discourage the recycling of such cans. The prior art has available various crushing apparatus and sets forth can crusher organizations, but has heretofore failed to provide an organization to effect the convenient crushing and storage of such organizations in a convenient manner. For example, U.S. Pat. No. 4,133,261 to Belfils sets forth a can crusher utilizing a reciprocatable ram overlying a plate with positioning tabs to position a can underlying the ram.

U.S. Pat. No. 4,168,661 to Wigdahal sets forth a can crusher apparatus wherein a sleeve is arranged to align a can to be crushed in association with a ram.

U.S. Pat. No. 4,459,908 to Sierk sets forth a can crusher or compactor utilizing a sleeve type member to crush a can within the sleeve.

U.S. Pat. No. 4,561,351 to Ader provides a crushing organization utilizing a levered plate to crush and compact the can between the plate and underlying platform.

U.S. Pat. No. 4,890,552 to Yelczyn sets forth a can crusher mounted to a vertical support wall, with a ram and underlying platform arranged in a conventional configuration.

As such, it may be appreciated that there continues to be a need for a new and improved can crusher apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of can crusher apparatus now present in the prior art, the present invention provides a can crusher apparatus wherein the same provides for crushing and storage of cans to compact the same for convenience of storage and disposal. As such, the general purpose of the present invention, which will be described subsequently in greater detail, is to provide a new and improved can crusher apparatus which has all the advantages of the prior art can crusher apparatus and none of the disadvantages.

To attain this, the present invention provides an apparatus including an upper housing containing spaced parallel side walls, with the side wall including aligned slots. A crusher bar is arranged to crush a can between a floor of the housing as the bar is directed through the slots. A push bar is pivotally mounted to a rear upper wall of the housing to project a crushed can into a storage container removably mounted to a lower forward wall of the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can crusher apparatus which has all the advantages of the prior art can crusher apparatus and none of the disadvantages.

It is another object of the present invention to provide a new and improved can crusher apparatus which may be easily and efficiently manufactured and marketed.

It is a further object of the present invention to provide a new and improved can crusher apparatus which is of a durable and reliable construction.

An even further object of the present invention is to provide a new and improved can crusher apparatus which is susceptible of a low cost of manufacture with regard to both materials and labor, and which accordingly is then susceptible of low prices of sale to the consuming public, thereby making such can crusher apparatus economically available to the buying public.

Still yet another object of the present invention is to provide a new and improved can crusher apparatus which provides in the apparatuses and methods of the prior art some of the advantages thereof, while simultaneously overcoming some of the disadvantages normally associated therewith.

Still another object of the present invention is to provide a new and improved can crusher apparatus wherein the same is arranged with a housing positioned adjacent a removable storage container for the convenient crushing and disposal of cans.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
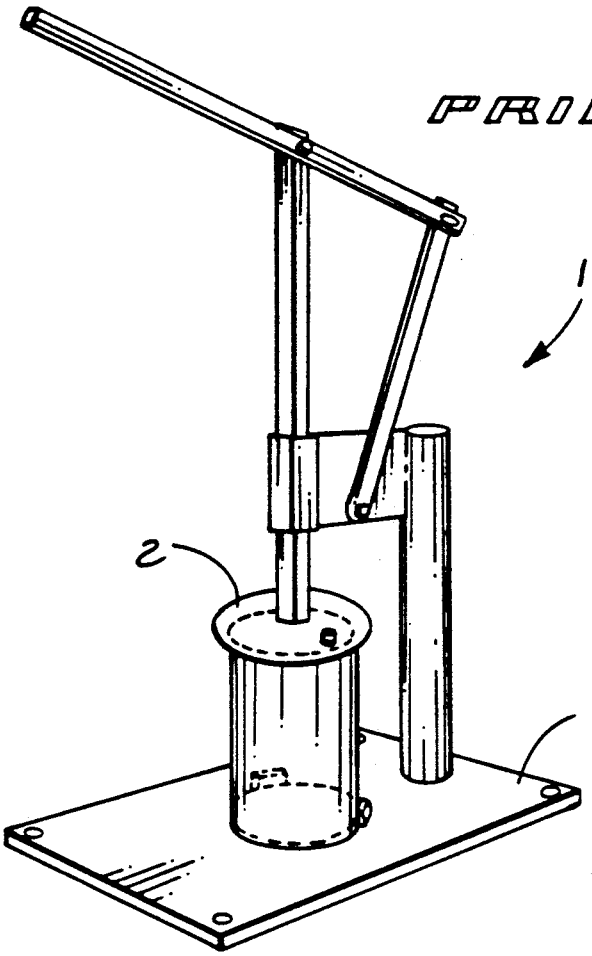
Fig 1 PRIOR ART
FIG. 1 is an isometric illustration of a prior art can crusher apparatus.

With reference now to the drawings, and in particular to FIGS. 1 to 8 thereof, a new and improved can crushing apparatus embodying the principles and concepts of the present invention and generally designated by the reference numeral 10 will be described.

FIG. 1 illustrates a prior art can crusher apparatus 1, with a ram 2 arranged to crush a can between the ram and an underlying platform 3, with positioning tabs circumferentially arranged about the can on the platform 3, in a manner as illustrated and set forth in U.S. Pat. No. 4,133,261.

Figure 2:
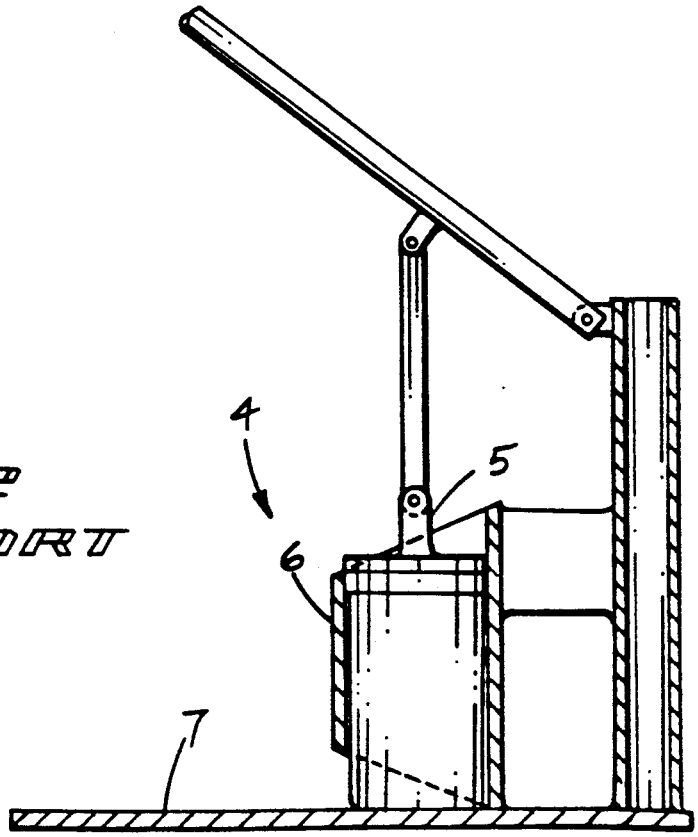
Fig 2 PRIOR ART
FIG. 2 is an orthographic side view, taken in cross-section, of a further example of a prior art can crusher apparatus.
Figure 3:
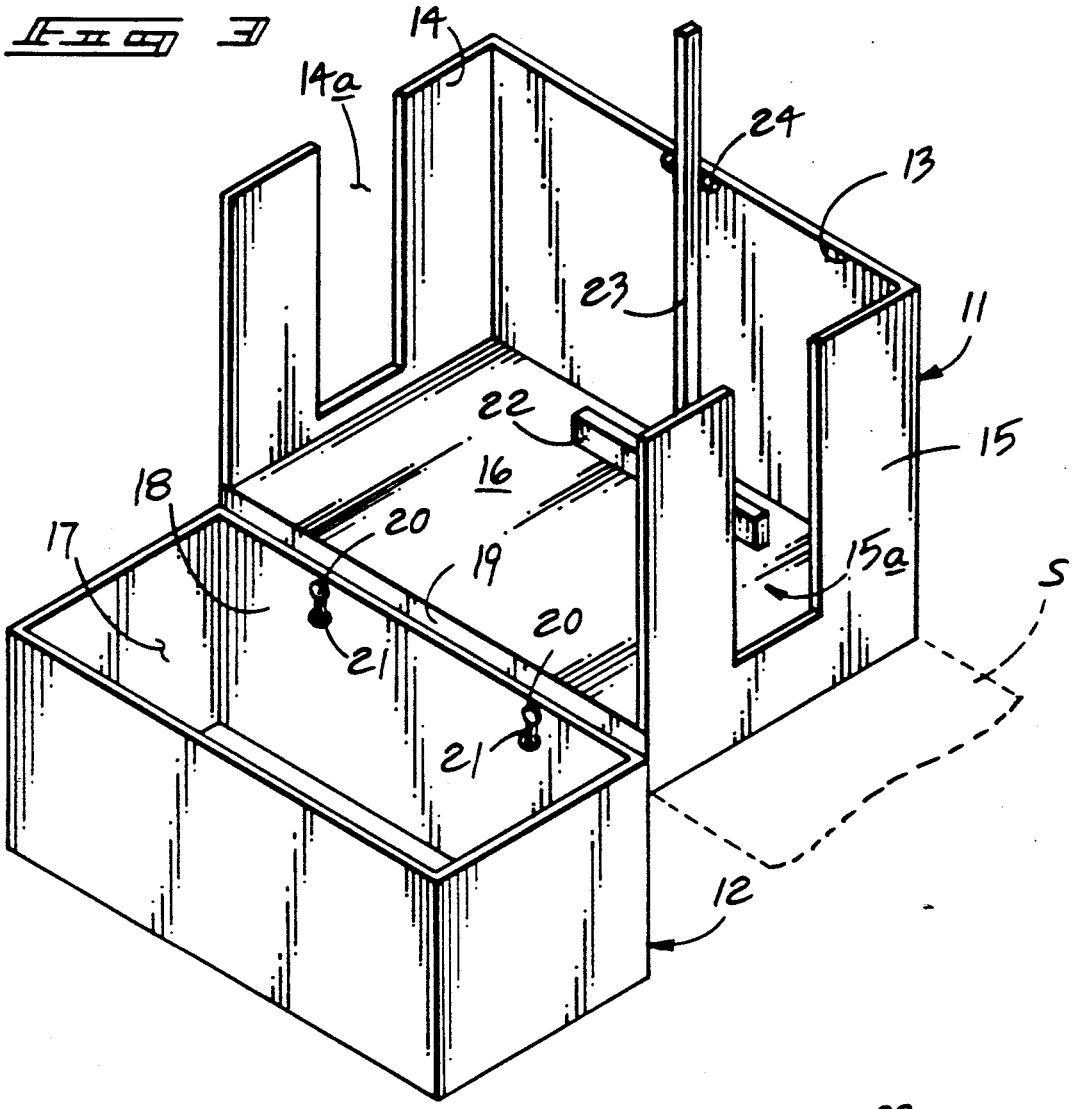
FIG. 3 is an isometric illustration of the housing and storage container utilized by the instant invention.
Figure 4:
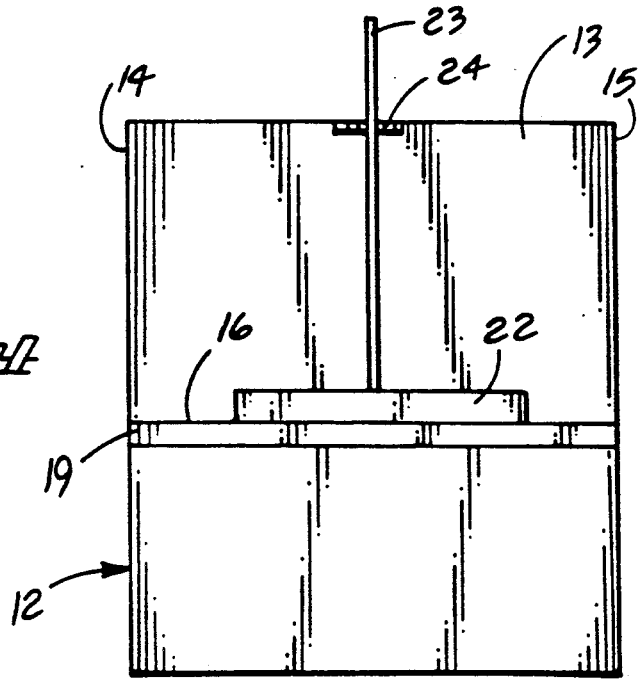
FIG. 4 is an orthographic front view, taken in elevation, of the apparatus as illustrated in FIG. 3.
Figure 5:
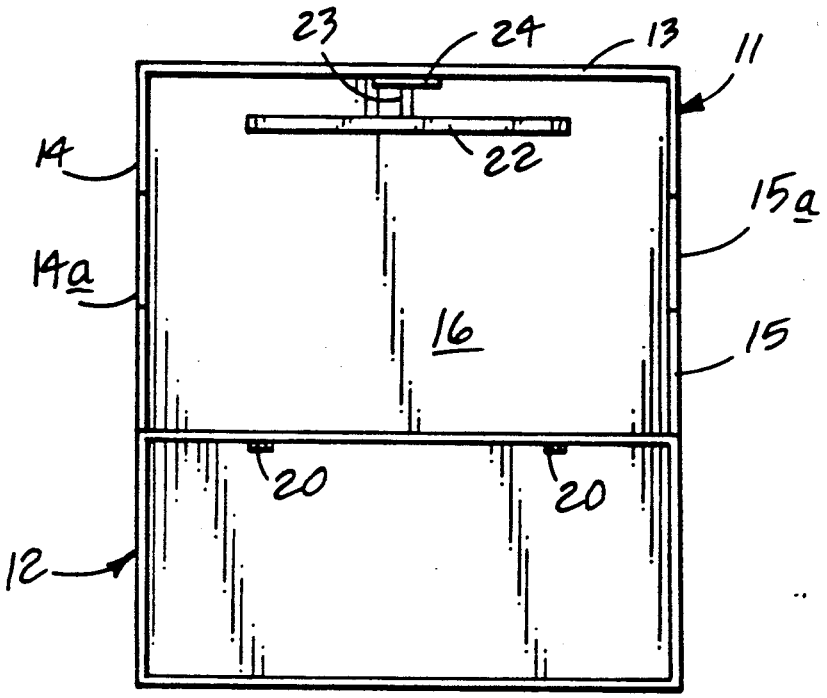
FIG. 5 is a top orthographic view of the apparatus, as illustrated in FIG. 4.
Figure 6:
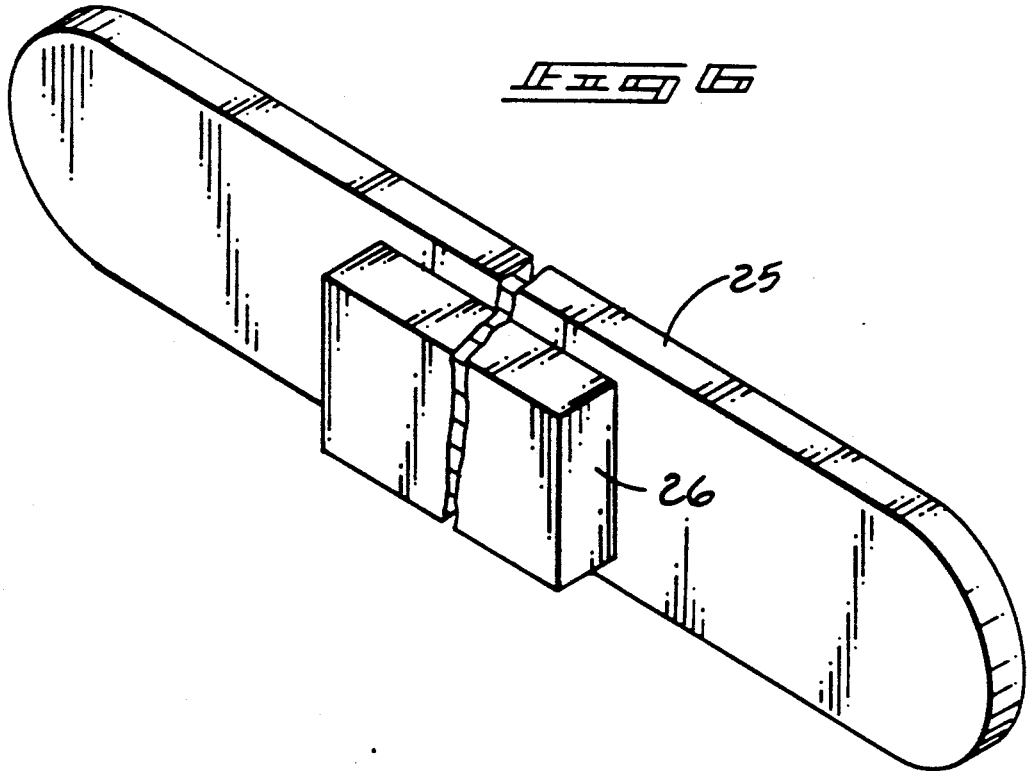
FIG. 6 is an isometric illustration of the crush plate utilized in conjunction with the housing of the instant invention.

FIG. 2 illustrates a further prior art can crusher apparatus 4, wherein the ram member 5 crushes a can between the ram and the platform 7, with a can constrained within a sleeve, in a manner as set forth in U.S. Pat. No. 4,168,661.

More specifically, the can crusher apparatus 10 of the instant invention essentially comprises an upper housing 11, with the upper housing 11 including a storage container 12 removably mounted thereto. The housing 11 includes a rear vertical wall 13 spaced from and parallel a housing forward vertical wall 19. The rear vertical wall 13 is orthogonally and fixedly secured to a housing floor 16 and extends upwardly from, while the housing forward wall 19 is orthogonally mounted to an extending below a forward edge of the housing floor 16 spaced from and parallel the rear vertical wall 13. A right "U" shaped side wall 14 is spaced from and parallel a left "U" shaped side wall 15, with each side wall including a respective right and left slot 14*a* and 15*a* which are aligned relative to one another.

The storage container 12 defines a container cavity 17 that is defined by a floor, side walls, and a forward wall, as well as a rear wall 18. The rear wall 18 includes a plurality of keyhole shaped openings 21 spaced apart a predetermined distance to receive a support pin 20 through each keyhole shaped opening, with the support pins 20 fixedly and orthogonally mounted to the housing forward vertical wall 19. In this manner, filling of the storage container 12 permits its subsequent removal for disposal of cans within the cavity 17 and subsequent replacement of the container 12 secured to the forward vertical 19.

Figure 8:
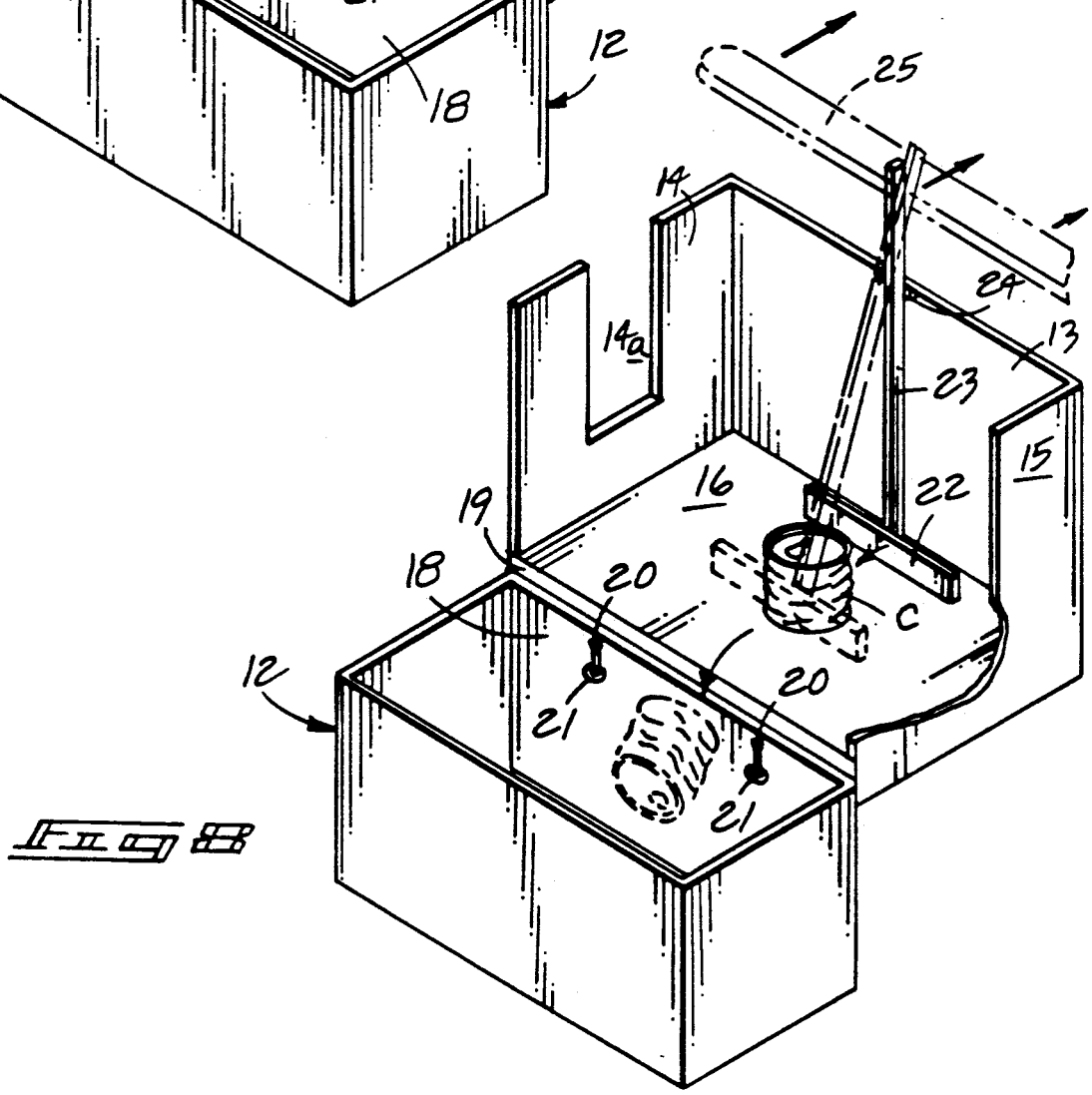
FIG. 8 is an isometric illustration of the invention setting forth the directing of a can subsequent to its compacting within the housing.

A push bar 22 is orthogonally and fixedly mounted to a lower terminal of a push bar rod 23. The push bar rod 23 extends from a vertical orientation relative to the floor 16 along the rear vertical wall 13 extending upwardly thereof and is defined by a first length greater than a predetermined height of the rear vertical wall 13. A hinge 24 mounted medially of an upper edge of the rear vertical wall 13 pivotally mounts the push bar rod 23 to the rear vertical wall 13 that upon crushing of a can, as illustrated in FIG. 8 for example, the push bar rod 23 is levered about the hinge 24, with the push bar 22 projecting the can "C" into the cavity 17.

Figure 7:
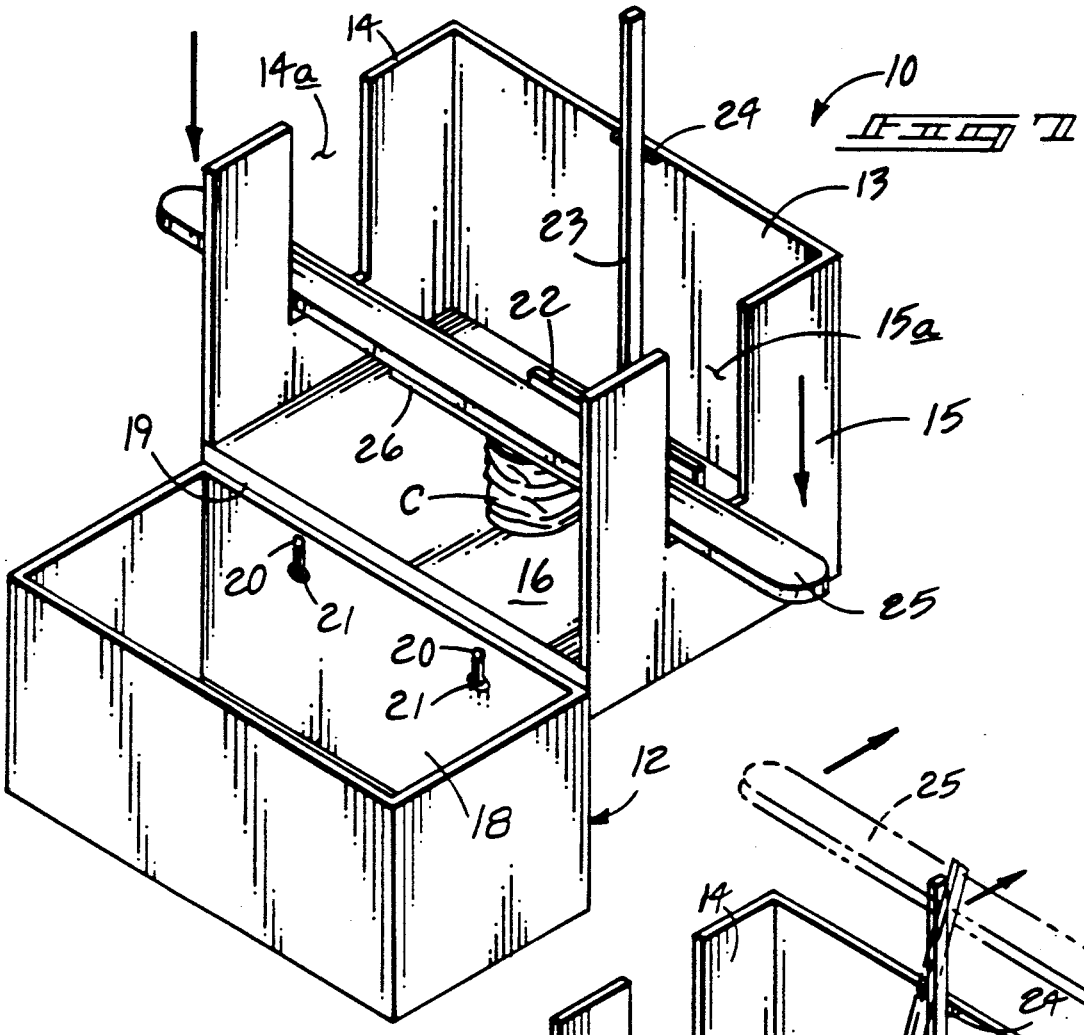
FIG. 7 is an isometric illustration of the instant invention in use.

A crush plate 25 is provided defined by a second length greater than a predetermined spacing between the right and left slots 14*a* and 15*a*, with the crush bar plate 25 extending beyond the slots to permit manual grasping thereof. A crush plate boss 26 is fixedly mounted to a bottom surface of the crush plate 25, whereupon the crush plate 25 projects downwardly to crush a can "C" positioned on the floor 16 between the slots 14*a* and 15*a*, as illustrated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can crusher apparatus comprising, an upper housing, the upper housing including a housing floor, a rear vertical wall orthogonally and fixedly mounted to the floor extending upwardly thereof, and the housing further including a right side wall and a left side wall, the right side wall and left side wall including a respective right slot and left slot, with the right and left slots aligned relative to one another, with the right and left walls arranged generally parallel relative to one another, and a storage container removably mounted to the housing, and a crush plate slidably received within the right slot and left slot to crush a can mounted upon the floor, and wherein the right side wall and left side wall are each of a generally "U" shaped configuration, and including a housing forward vertical wall that is orthogonally and fixedly mounted to a forward edge of the floor and extending below the floor parallel to the rear vertical wall, and the forward vertical wall including a plurality of support pins spaced apart a predetermined spacing, and the storage container including a storage container floor, a storage container forward wall, and storage container right wall, and a storage container left wall, and a storage container rear wall, wherein the storage container rear wall includes a plurality of keyhole shaped openings spaced apart the predetermined spacing, the keyhole shaped openings arranged for securement to the support pins, and including a push bar rod, the push bar rod defined by a first length greater than a predetermined height defined by the rear vertical wall, and a hinge mounted medially of an upper terminal edge of the rear vertical wall, with the hinge hingedly mounting the push bar rod to the upper terminal edge of the rear vertical wall, and a push bar rod orthogonally and fixedly mounted to a lower terminal end of the push bar rod and extending parallel to the rear vertical wall, and wherein the crush plate is defined by a second length greater than a further spacing defined between the right and left slots of the respective right and left side walls to extend beyond the right and left side walls when positioned within the right and left slots, and the crush plate including a crush plate boss fixedly mounted to a bottom surface of the crush plate medially thereof to secure and crush a can positioned between the floor and the crush plate boss.

* * * * *